United States Patent [19]

Garcia De Couto

[11] Patent Number: 4,791,689

[45] Date of Patent: Dec. 20, 1988

[54] MECHANISM FOR FILLING AND DISCHARGING A TOILET TANK

[76] Inventor: Manuel Garcia De Couto, Calle Tepuy, Residencia Trigal Apto. 9-A Parque Humboldt, Caracas, Venezuela, 9791993

[21] Appl. No.: 61,132

[22] Filed: Jun. 10, 1987

[51] Int. Cl.[4] ..... E03D 1/36

[52] U.S. Cl. ..... 4/366; 4/405; 137/420

[58] Field of Search ..... 4/300.3, 366, 381, 386, 4/387, 394–397, 400, 405, 413; 137/420

[56] References Cited

U.S. PATENT DOCUMENTS

| | | | |
|---|---|---|---|
| 1,203,538 | 10/1916 | Hamilton | 4/366 X |
| 1,910,082 | 5/1933 | Bell | 4/366 |
| 3,619,821 | 11/1971 | Bobo | 4/366 |
| 4,120,055 | 10/1978 | Mormile | 4/366 X |
| 4,318,194 | 3/1982 | Pinkston | 4/36 |
| 4,341,238 | 7/1982 | Roosa et al. | 4/366 X |
| 4,411,029 | 10/1983 | Huang | 4/405 X |

*Primary Examiner*—Donald Watkins
*Attorney, Agent, or Firm*—Ladas & Parry

[57] ABSTRACT

Apparatus for filling a toilet tank with water and discharging the water therefrom has a valve base for supplying water to the toilet tank. A valve is in a hollow passage of the valve base for closing the hollow passage to the supply of water when pulled vertically. An axle is connected at one end to the valve plug. An axle floater is on the opposite end of the axle for pulling the valve vertically when the toilet tank is full of water. A buoy base discharges water from the toilet tank. A discharge buoy closes the buoy base until pulled from the buoy base, and then floats on the water in the toilet tank back to the buoy base as the water is discharged. A pulling chain connects the discharge buoy to a command lever which is tiltable by a command handle on the outside of the toilet tank to pull the discharge buoy from the buoy base with the pulling chain. The command lever also engages the axle, to tilt the axle when the command lever is tilted, which opens the valve for supplying the water.

4 Claims, 3 Drawing Sheets

MECHANISM FOR FILLING AND DISCHARGING A TOILET TANK

BACKGROUND OF THE INVENTION

The invention relates to a mechanism for filling and discharging a water tank of a toilet for flushing its toilet bowl.

SUMMARY OF THE INVENTION

The invention and its general operation are described as follows.

A light manual pressure on a command handle on the outside of a toilet tank tilts a connected command lever in the toilet tank. The command lever is connected to a drainage buoy in a buoy base with a pulling chain to pull the drainage buoy from the buoy base when the command lever is tilted, whereupon the drainage buoy floats until the buoy base releases all the water from the tank by discharge into the toilet bowl. The same tilting action of the command lever also tilts an axle engaged by the command lever, which opens a valve on one end of the axle to allow new water to flow into the toilet tank. The discharge of water from the toilet tank is completed when there is insufficient water to float the drainage buoy and it settles down, by gravity, back into the buoy base, to close it again and stop the discharge of water, thereby allowing the toilet tank to refill with the new water from the valve on the axle. The filling continues until the rise of the water level floats an axle floater on the opposite end of the axle from the valve sufficiently to put the axle in a vertical position and pull it vertically upwards. This closes the valve, and the tank is then full for another discharge operation. A pressure reducer at the valve can reduce the pressure of the water let into the tank, if the water flows in at too high a pressure.

DESCRIPTION OF THE DRAWN EMBODIMENT

The embodiment of a mechanism to control the filling and discharge of water in a toilet tank is structurally and operationally simple and efficient. It consists of a few simple parts, namely;

Command Handle 1,
Command Lever 2,
Pulling Chain 3,
Drainage Buoy 4,
Buoy Base 5,
Valve Base 6,
Valve 7,
Umbrella-Cap 8,
Axle 9,
Axle Floater 10, and
Pressure Reducer 11.

The command handle 1 is the only external component of the mechanism. It is operated (tilted), typically, manually. It has a hollow suitable to house and anchor an end 2-C of the command lever 2 which projects through the toilet tank T for this.

Figure 1:
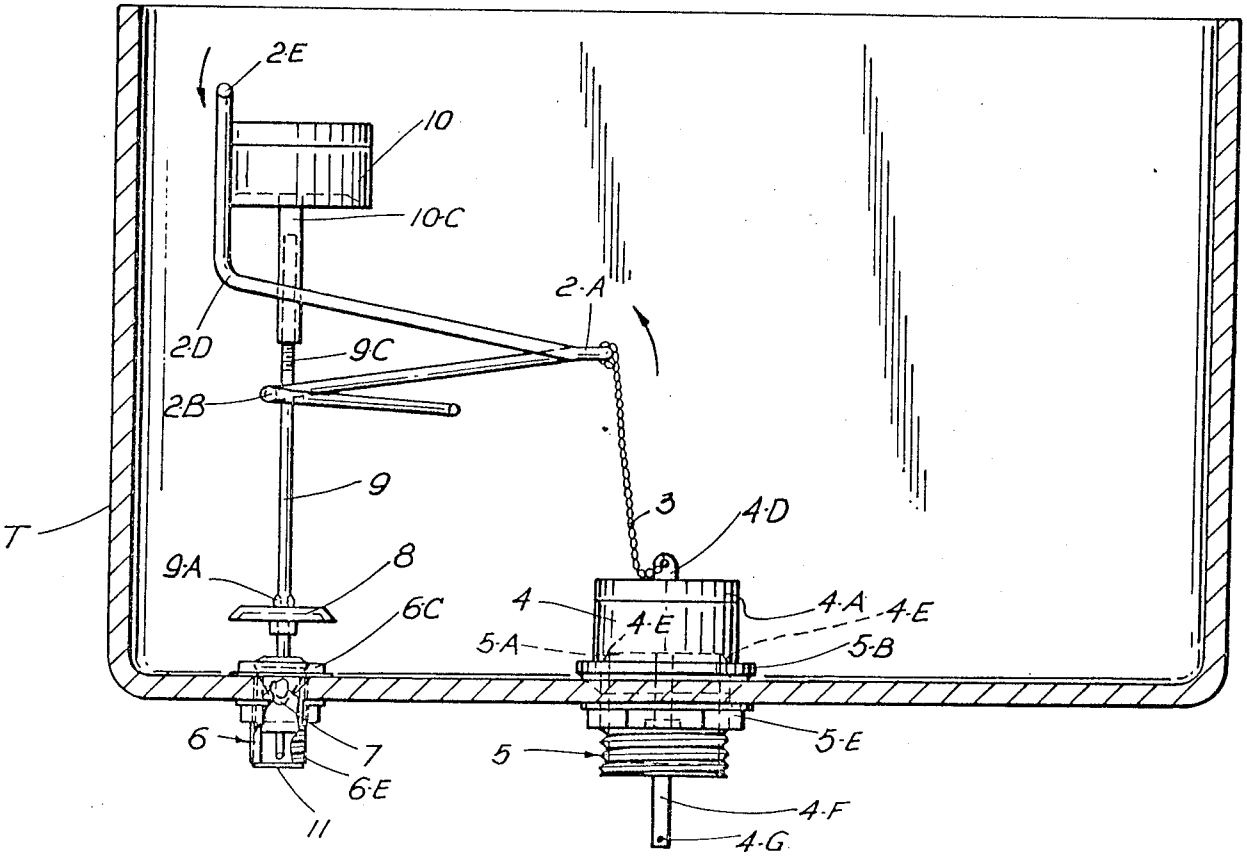
FIG. 1 is a front elevation of an embodiment of the mechanism, partly broken away, in a toilet tank, in cross section on line I—I of FIG. 2, for use.
Figure 2:
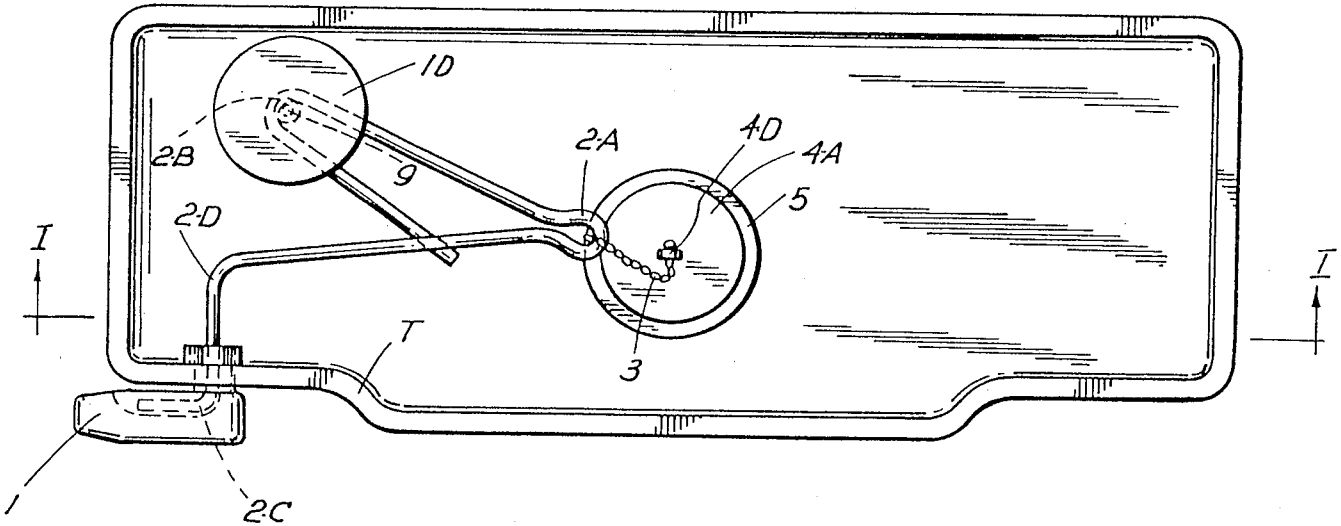
FIG. 2 is a top plan view of the embodiment and toilet tank of FIG. 1.
Figure 8:
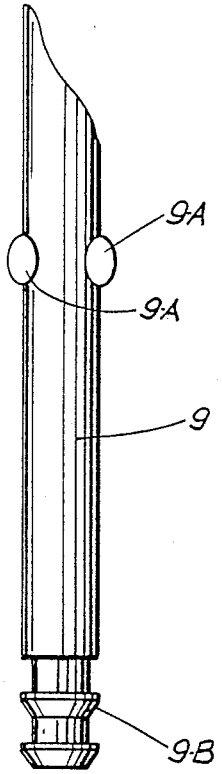
FIG. 8 is an enlarged elevation of a portion of an axle portion of the embodiment of FIG. 1.
Figure 3:
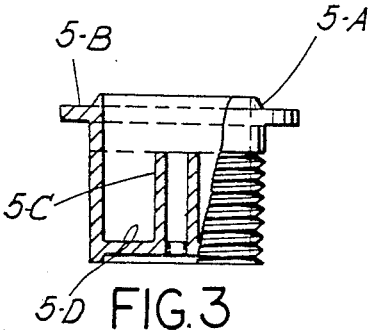
FIG. 3 is an elevation, partly in cross section, of a buoy base portion of the embodiment of FIG. 1.
Figure 5:
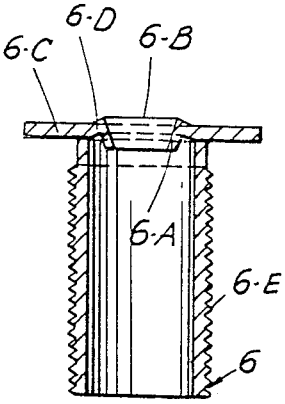
FIG. 5 is an enlarged, cross-sectional elevation of a valve base portion of the embodiment of FIG. 1.
Figure 4:
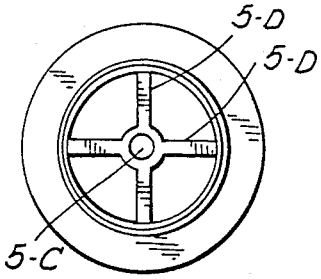
FIG. 4 is a top plan view of the buoy base portion of FIG. 3.
Figure 6:
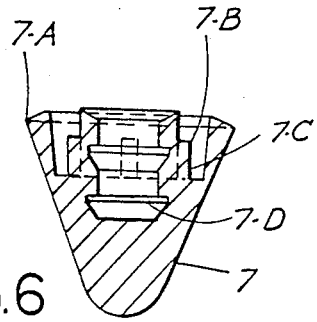
FIG. 6 is an enlarged, cross-sectional elevation of a valve portion of the embodiment of FIG. 1.
Figure 7:
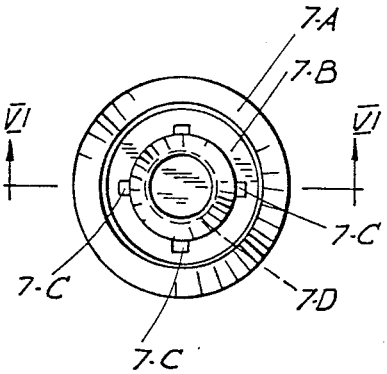
FIG. 7 is a top plan view of the valve portion of FIG. 6.
Figure 9:
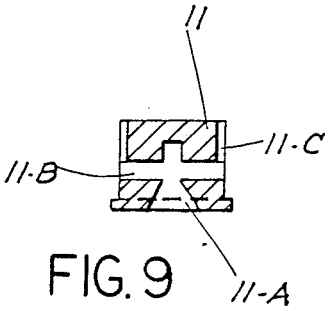
FIG. 9 is an enlarged cross-sectional elevation of pressure reducer portion of the embodiment of FIG. 1.

The command lever 2 is a metal bar having five bends which give it the particular, irregular shape shown in FIGS. 1 and 2 of the drawing. Starting from its end 2-C attached to the command handle 1, a first bend turns it horizontally 90° for entering the toilet tank T from its coupling to the hollow of the handle. A second bend 2-E turns it from horizontal to vertical inside the tank. A third bend 2-D turns it from vertical to inclined, at an angle somewhat greater than 90° from vertically upward. A fourth bend 2-A makes a U-shape, upon which is anchored one of the ends of the pulling chain 3, from which the command lever bar continues to slope slightly towards the bottom of the tank T to a hook bend 2-B about the axle 9.

The pulling chain 3 can be a metal chain or a cord or a string, because it merely transmits the action of the command lever 2 to the drainage buoy 4, which is connected to its opposite end from that anchored to the command lever. That is, when the command handle is tilted counterclockwise, it correspondingly tilts the connected command lever 2, as shown by the arrows in FIG. 1, to pull the pulling chain 3 and, thus, the drainage buoy 4 upwards.

The drainage buoy 4 is a floatable assembly. It has a cylindrical shape and primarily consists of an upper cap 4-A on a lower main body 4-B, which is cup shaped to define an internal chamber. The coupling of these parts is a fixed, permanent watertight closure to keep the internal chamber free of water. At the outer center of the upper cap is a projection 4-D with an orifice to hold the pulling chain 3. Around the opposite end of lower main body is a continuous, triangular-section flange 4-E with a conicity coinciding with an uppermost seat 5-A on the buoy base 5 to secure watertight closure between these parts while in the closed position shown in FIG. 1. A rod-shaped axle guide 4-F projects from the center of the opposite end of the lower main body 4-B to a lowermost end, which has an orifice 4-G on the opposite side of the buoy base 5 from the lower main body through which a pin-butt is passed to keep the drainage buoy 4 from slipping out of its operating place on the buoy base when pulled from its seat thereon by the pulling chain 3 and allowed to float.

The buoy base 5 is a generally cylindrical, hollow part that is fastened onto the bottom of the toilet tank T at its point of discharge. The buoy base has lower, external threading, so that it can be held in place with a regular nut 5-E. Its upper end is provided with an external, surrounding, salient head 5-B, which has the seat 5-A for the drainage buoy and provides a circumferential fixation butt therefor. Its bottom has a central, cylindrical guide-case 5-C, which is fixed to the rest of the buoy base with radial projection 5-D. This guide-case serves to conduct the vertical sliding to the axle guide 4-F.

The valve base 6 is another cylindrical, hollow part that is fastened to the bottom of the toilet tank T, in this case at its point of water inlet. The valve base is also provided with external, lower threading 6-E, so that it may be held in place with a regular nut and its upper end is also provided with an external, salient, surrounding head 6-C, which serves as a seat and fixation butt. For its seat function, the central portion of its upper end is substantially a truncated cone having a lowermore smaller circular base for producing a seat ring 6-A for a rounded end 7-A of the valve 7. The lower end threading is also appropriate for connection to a water supply pipe (not shown).

The valve 7 is a cone-shaped part, converging downwardly, with a slightly rounded off, spherical-like, uppermost circular end (cone base) 7-A. At the center of its cone base end 7-A, it has a cylindrical cavity with axially successive, correspondingly conical sectors, so as to achieve the internal rings 7-D for fasteners 9-B on one end of the axle 9 when inserted therein. A generally cylindric empty space 7-B extends concentrically about the full circumference of the cone base end 7-A of the valve. It is destined to receive the impact of the water under pressure supplied to the valve and keeps the valve open while the toilet tank is filling. Inside this empty space 7-B are four radially protruding stops 7-C which perform as fasteners in the stripping operation during the manufacture of this part. Within the empty space 7-B is a portion of the surface of the cone base end 7-A for valve closure in cooperation with the circular ring seat 6-B of the valve base.

The umbrella cap 8 is a disk having a shape similar to an umbrella. In its center, it has a hole, which may have internal threading (not shown) for fastening to the axle. This hole also may not have the threading when projections 9-A are provided on the axle to hold the umbrella cap down when it receives the impact of the water coming from the valve, as intended, thus avoiding any splash or deflect any squirting of the water out of the toilet tank T.

The axle 9 is a bar that, in this embodiment, is threaded at one, upper end 9-C, but could be threaded along most of its length. Its opposite, lower end has one or more salient rings 9-B that form the fasteners which are fitted into their corresponding rings 7-D in the valve 7. The umbrella cap 8 is anchored between its ends, in this case on the projections 9-A which set the maximum height position of the umbrella cap. Approximately at its central point, the axle 9 is embraced by the bend 2-B of the command lever for tilting thereby.

The axle floater 10 is a cylindrical floater assembly, consisting of an upper cover and lower main body, like the drainage buoy. A hollow stem 10-C projects from the center of one, lower external plane surface. This stem has internal threading for anchorage with axle 9.

The pressure reducer 11 is a plug which is permanently fixed within the open, lower end of the valve base 6. It has a cylindrical shape with a projection ring at its lower end that functions as a stop on the lower end of valve base. The lower end has a vertical, ascending orifice that does not reach the upper end of the pressure reducer, i.e. it is a blind hole. The lower entrance of the aforementioned orifice is expanded into a conical shape 11-A. Another orifice 11-B extends horizontally and diametrically through the pressure reduce, intersecting the ascending orifice. It remains open at both of its ends. For this, on the external, cylindrical surface of the pressure reducer, starting at each end of the horizontal orifice 11-B, there is a vertical, ascending channel 11-C which reaches to the top end of the pressure reducer. This reduces the pressure of water coming from the water system into the valve when the inflow pressure is very high.

I claim:

1. Apparatus for filling a toilet tank with water and discharging the water therefrom, comprising:

a valve base for fastening to a toilet tank, the valve base having a hollow passage therethrough opening vertically into the toilet tank at one end for supplying water to the toilet tank from the one end of the hollow passage when the valve base is fastened to the toilet tank;

a valve plug in the hollow passage for closing the hollow passage to the supply of water from the hollow passage when pulled vertically toward the one end of the hollow passage;

an axle connected at one end to the valve plug;

an axle floater on the opposite end of the axle for pulling the valve plug vertically toward the one end of the hollow passage when the toilet tank is full water;

a buoy base for discharging water from the toilet tank when fastened thereto;

a discharge buoy for closing the buoy base until pulled from the buoy base, and then floating on the water in the toilet tank back to the buoy base as the water in the toilet tank is discharged therefrom;

a pulling chain connected to the discharge buoy at one end; and a command lever connected to the opposite end of the pulling chain and engaging the axle for tilting by a command handle on the outside of the toilet tank, whereby to pull the discharge buoy base and tilt the axle, the valve plug then allowing the supply of water from the hollow passage.

2. The apparatus of claim 1, and further comprising:

a pressure reducer in the hollow passage on the opposite side of the valve plug from the one end of the hollow passage.

3. The apparatus of claim 1, and further comprising:

an umbrella cap fastened about the axle between the ends thereof for deflecting the water supplied from the one end of the hollow passage.

4. The apparatus of claim 2, and further comprising:

an umbrella cap fastened about the axle between the ends thereof for deflecting the water supplied from the one end of the hollow passage.

* * * * *